US006106331A

United States Patent [19]

Kurotori et al.

[11] Patent Number: 6,106,331

[45] Date of Patent: Aug. 22, 2000

[54] CONNECTOR ASSEMBLY

[75] Inventors: Fumio Kurotori; Kazuyuki Futaki; Hiroyuki Suzuki, all of Tokyo, Japan

[73] Assignee: Fujitsu Takamisawa Component Limited, Tokyo, Japan

[21] Appl. No.: 09/181,910

[22] Filed: Oct. 29, 1998

[51] Int. Cl.[7] ..... H01R 13/73; H01R 13/60; H01R 13/648

[52] U.S. Cl. ..... 439/567; 439/541.5

[58] Field of Search ..... 439/931, 607, 439/567, 541.5, 64, 701, 717

[56] References Cited

U.S. PATENT DOCUMENTS 5,044,984 9/1991 Mosser et al. ..... 439/931
5,161,999 11/1992 Broschard, III et al. ..... 439/607
5,167,531 12/1992 Broschard, III et al. .
5,468,160 11/1995 Broschard, III et al. ..... 439/567
5,823,822 10/1998 Tan et al. ..... 439/541.5

FOREIGN PATENT DOCUMENTS 6-29061 4/1994 Japan .

*Primary Examiner*—Gary F. Paumen
*Assistant Examiner*—Edwin A. Leon
*Attorney, Agent, or Firm*—Staas & Halsey, LLP

[57] ABSTRACT

A connector assembly for receiving a cable with a plurality of wires includes a body including a plurality of contacts provided on the front face of the body; a plurality of leads for connecting the contacts to a plurality of contact points provided on a circuit board to which the connector assembly is attached; a pair of brackets provided on the either ends of the body; and a pair of board locks, provided on the brackets, for fastening the connector assembly to the circuit board.

3 Claims, 7 Drawing Sheets

CONNECTOR ASSEMBLY

BACKGROUND OF THE INVENTION

1. Field of the Invention

The invention relates to a connector assembly for cable assemblies each of which includes a plurality wires and pins or receptacles connected to the respective wires.

2. Description of the Related Art

A cable assembly has been used to connect devices, such as a printer, an external hard drive or a scanner to a computer or to connect computers to each other. The cable assembly generally includes a plurality of wires and pins or receptacles as multiple contacts connected to the respective wires. Such a cable is adapted to connect to a connector assembly which is attached to a circuit board of a device or a computer.

FIG. 7 shows a connector assembly 100 of a prior art, which includes upper and lower connectors 110 and 120 stacked or connected to each other. The upper connector 110 comprises an electrically insulating body 112. Provided in the front face of the body 112 is a recess 112*a* within which a plurality of contacts 114 are arranged in an array and are secured to the body 112. Metal brackets 116, for connecting the upper connector 110 to the lower connector 120, are secured to the body 112 at the either ends thereof. The contacts 114 are connected to corresponding contact points on a circuit board 134 by a plurality of L-shaped leads 118 when the connector assembly 100 is attached to the circuit board 134.

The lower connector 120 has substantially the same configuration as the upper connector 110, and includes an electrically insulating body 122. Provided in the front face of the body 122 is a recess 122*a* within which a plurality of contacts 124 are arranged in an array and are secured to the body 122. Metal brackets 126, for connecting the lower connector 120 to the circuit board 134, are secured to the body 122 at the either end thereof. The contacts 124 are connected to corresponding contact points on the circuit board 134 by a plurality of L-shaped leads 118 when the connector assembly 100 is attached to the circuit board 134.

Spacers 128 and 130 of an electrically insulating material are inserted between the brackets 116 and 126 of the upper and lower connectors 110 and 120, and between the bracket 126 of the lower connector 120 and the circuit board 134, respectively. According to the prior art, holes are provided extending through the circuit board 134, the spacers 130, the brackets 126, and the spacers 128, through which screw fasteners 132 are inserted so that the fasteners 132 threadly engage threaded holes 116*a* provided in the brackets 116 of the upper connector to secure the connector assembly 100 to the circuit board 134.

As can be seen from the illustration of FIG. 7, according to the prior art, attachment of the connector assembly to a circuit board by screw fasteners reduces the efficiency of assembly work of the connector assembly to a circuit board, and increases time and cost for manufacturing.

SUMMARY OF THE INVENTION

The invention is directed to solve the prior art problems, and to provide a connector assembly improved to facilitate the assembly work of the connector assembly to a circuit board.

According to the invention, there is provided a connector assembly for receiving a cable assembly with a plurality of wires, comprising a body including a plurality of contacts provided on the front face of the body; a plurality of leads for connecting the contacts to a plurality of contact points provided on a circuit board to which the connector assembly is attached; a pair of brackets provided on the either ends of the body; and a pair of board locks, provided on the brackets, for fastening the connector assembly to the circuit board.

Preferably, the connector assembly includes first and second connectors which are connected to provide the connector assembly, the first and second connectors including first and second bodies, respectively, which are adapted to provide the body of the connector assembly when the first and second connectors are connected to each other; brackets attached to the either ends of the first and second bodies, each of the brackets including a recess which is adapted to provide a board lock receiving recess when the first and second connectors are connected to each other; board locks including legs for attaching the connector assembly to a circuit board; and the board locks being fitted into the board lock receiving recesses of the brackets to connect the first and second bodies to each other.

According to another feature of the invention, the connector assembly includes first and second connectors which are connected to provide the connector assembly, the first and second connectors including first and second bodies, respectively, which are adapted to provide the body of the connector assembly when the first and second connectors are connected to each other, the second connector contacting a circuit board when the connector assembly is attached to the circuit board; brackets attached to the either ends of the first and second bodies, each of the brackets attached to the second body including slits; board locks including legs for attaching the connector assembly to a circuit board, the board locks being inserted into the slit provided in the brackets of the second bodies; and connecting members including first and second openings into which the first and second brackets are inserted to connect the first and second bodies to each other.

DESCRIPTION OF THE DRAWINGS

These and other objects and advantages and further description will now be discussed in connection with the drawings in which.

DESCRIPTION OF THE PREFERRED EMBODIMENTS

The invention will be described further in detail, with reference to the attached drawings, in which a connector assembly includes two connectors. However, the invention is not limited to the embodiment including two connectors. The invention can be applied to a connector assembly including three or more connectors.

Figure 1:
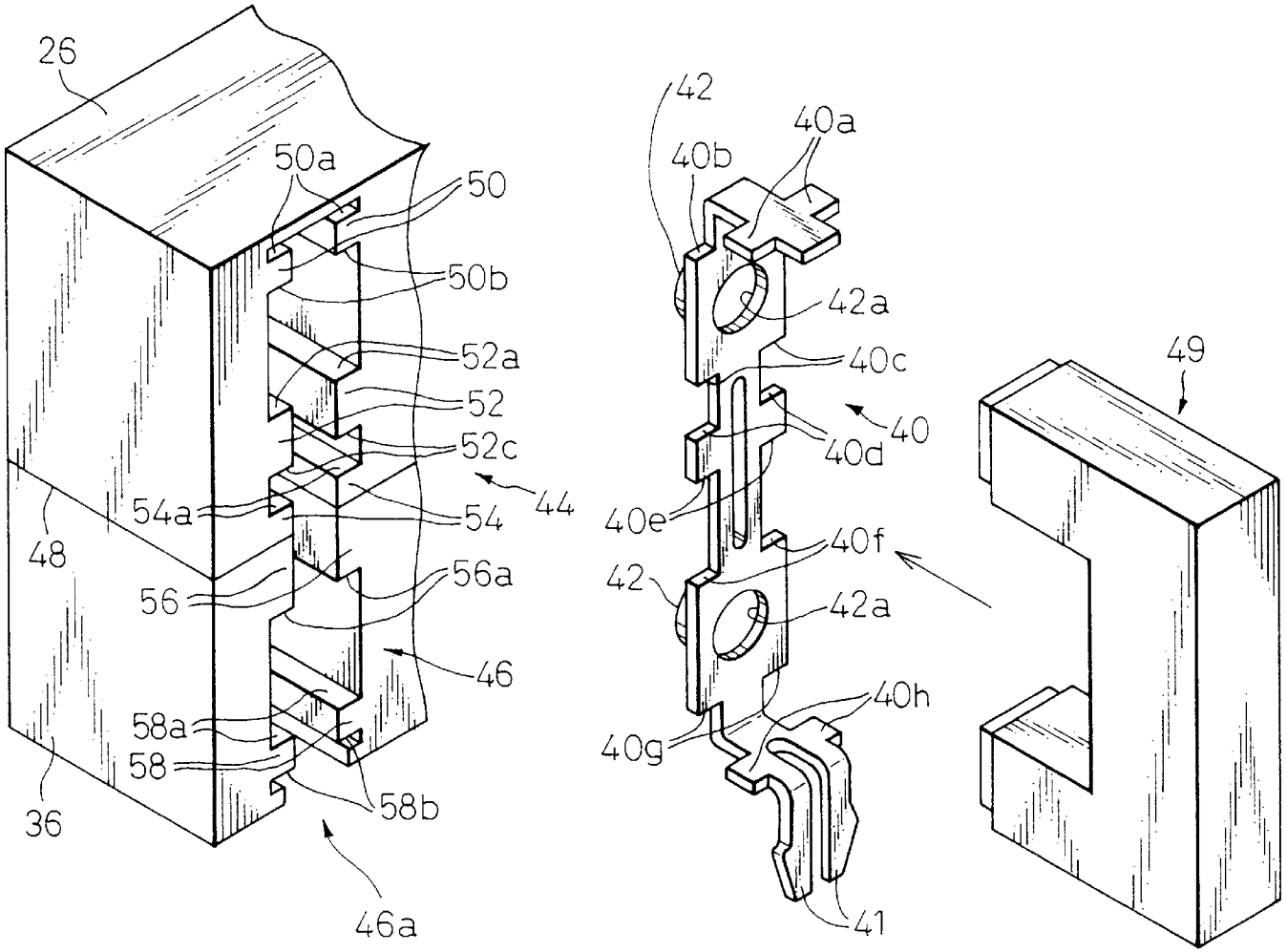
FIG. 1 is an exploded perspective rear view of a connector assembly according to a first embodiment of the invention.
Figure 2A:
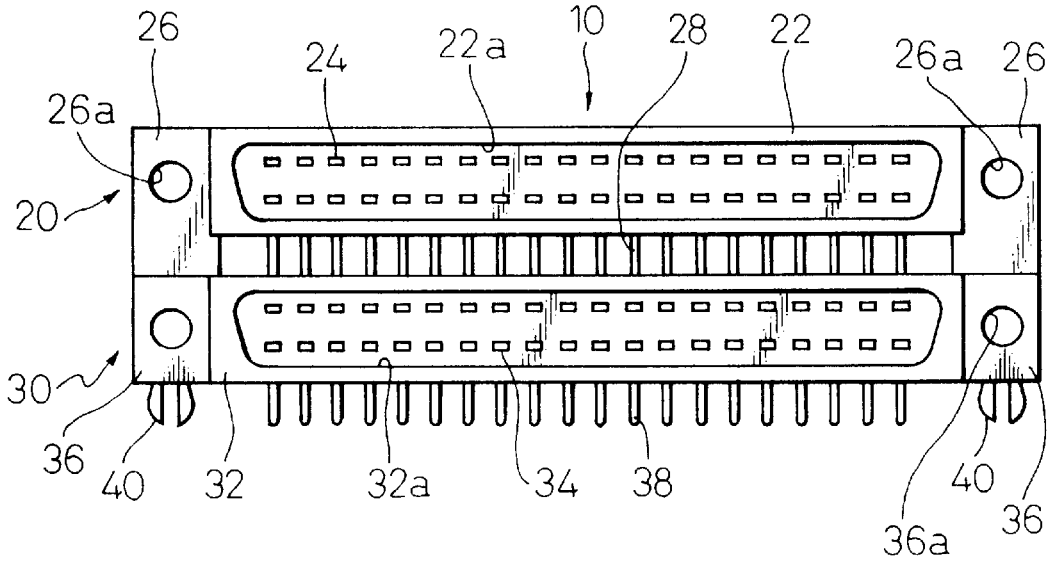
FIG. 2A is a front view of the connector assembly of FIG. 1.
Figure 2B:
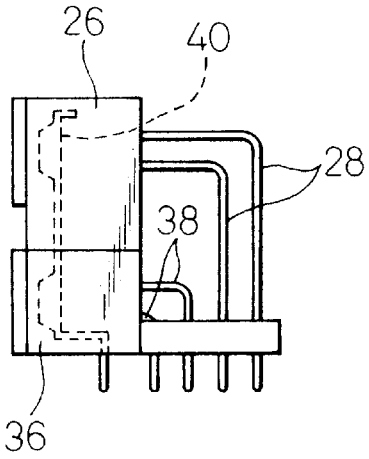
FIG. 2B is a side view of the connector assembly of FIG. 1.
Figure 3:
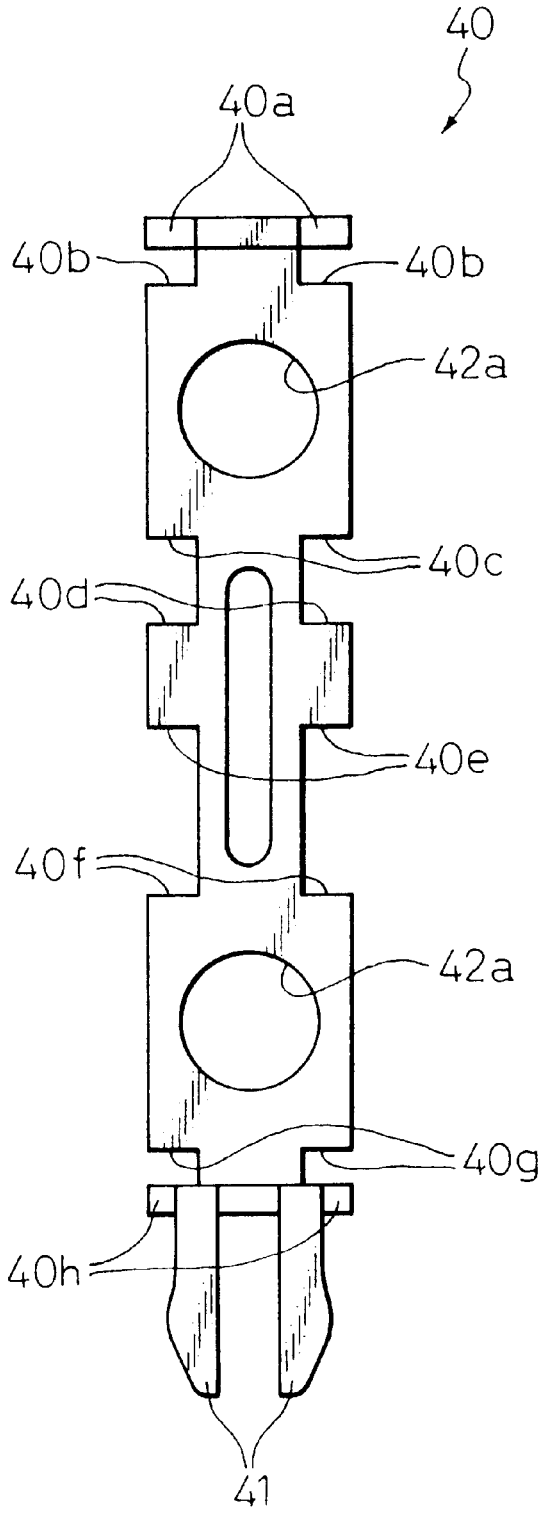
FIG. 3 is a font view of a board lock according to the first embodiment of the invention.

With reference to FIGS. 1–3, the first embodiment of the invention will be described below.

A connector assembly 10 according to the first embodiment of the invention includes first and second connectors 20 and 30 which are connected to each other. Joint surface 48 is defined between the connected first and second connectors 20 and 30. Although, in the drawings, the first connector 20 is disposed over the second connector 30, it may be understood that, in an actual configuration, the first and second connectors 20 and 30 may be disposed side by side or upside down relation, depending on the orientation of a circuit board to which the connector assembly is attached.

The first connector 20 includes a substantially rectangular parallelepiped body 22 of an electrically insulating material. Provided in the front face of the body 22 is a recess 22*a* within which a plurality of contacts 24 are arranged in an array and secured to the body 22. The contacts 24 are connected to corresponding contact points on a circuit board (not shown) by a plurality of L-shaped leads 28 (FIG. 2) when the connector 10 is attached to a circuit board.

Metal brackets 26, for connecting the first connector 20 to the second connector 30, are secured to the body 22 at the either ends thereof. The metal brackets 26 include holes 26*a* through which screws (not shown), for fastening a cable assembly (not shown) to the first connector 20, are received. The cable assembly generally includes a plurality of wires and pins or receptacles as multiple contacts connected to the respective wires. The pins or receptacles are arranged to connect to the contacts 24 when the cable assembly is attached to the first connector.

The second connector 30 has substantially the same configuration as the first connector 20, and includes a substantially rectangular parallelepiped body 32 of an electrically insulating material. Provided in the front face of the body 32 is a recess 32*a* within which a plurality of contacts 34 are arranged in an array and secured to the second body 32. The contacts 34 are connected to corresponding contact points on a circuit board (not shown) by a plurality of L-shaped leads 38 (FIG. 2) when the connector assembly 10 is attached to a circuit board. Metal brackets 36, for connecting the second connector 30 to a circuit board (not shown), are secured to the body 32 at the either end thereof. The metal brackets 36 also include holes 36*a* through which screws (not shown), for fastening a cable assembly to the second connector 30, are received.

Provided in the respective back faces of the first and second connectors 20 and 30 are recesses 44 and 46. The recesses 44 and 46 are adapted to provide board lock receiving recesses when the first and second connectors 20 and 30 are connected to each other. The board lock receiving recess receives a board lock 40 for connecting the first and second connectors 20 and 30 to each other.

The recesses 44 and 46 include rectangularly profiled sidewalls adapted to the form of the board locks 40. In particular, first, second and third pairs of protrusions 50, 52 and 54 extend from the inner surface of the recesses 44 of the first connector 20. The first pair of protrusions 50 are disposed in the side surface farthest from the joint surface 48 for the second connector 30. The third pair of protrusions 54 are arranged adjacent to the joint surface 48. The second pair of protrusions 52 are disposed between the first and third pairs of protrusions 50 and 54. Fourth and fifth pairs of protrusions 56 and 58 extend from the inner surface of the recesses 46 of the second connector 30. The fourth pair of protrusions 56 are disposed adjacent to the joint surface 48 for the first connector 20. The fifth pair of protrusions 58 are disposed in the side surfaces deepest from the joint surface 48. Further, the brackets 36 of the second connector 30 include slits 46*a* between the recess 46 and joint surface 48 for a circuit board. Each of the slits 46*a* allows locking members 41 of a board lock 40 to extend from the bracket 36, as described below.

The board lock 40 is made of phosphor bronze to include a plurality of engaging portions 40*a*–40*g* which engage the profiled side walls of the recesses 44 and 46, and a locking portion which includes a pair of legs 41. The board lock 40 further includes bosses 42 with threaded inner surfaces 42*a* which receive screws (not shown) for fastening a cable (not shown) to the connector assembly 10. The legs 41 are adapted to be inserted to a hole or holes in a circuit board to function as a snap-in fastener for locking the connector assembly 10 to the circuit board.

In particular, the board lock 40 includes first pair of engaging portions 40*a* which engage side faces 50*a*, distant from the joint surface 48 for the second connector 30, of the first pair of protrusions 50, second pair of engaging portions 40*b* which engage side faces 50*b* opposite to the side faces 50*a* of the first pair of protrusions 50, third engaging portions 40*c* which engage side faces 52*a*, distant from the joint surface 48 for the second connector 30, of the second pair of protrusions 52, fourth pair of engaging portions 40*d* which engage side faces 52*c* opposite to the side faces 52*a* of the second pair of protrusions 52, fifth pair of engaging portions 40*e* which engage side faces 54*a* of the third pair of protrusions 54, sixth pair of engaging portions 40*f* which engage side faces 56*a* of the fourth pair of protrusions 56, seventh pair of engaging portions 40*g* which engage side faces 58*a*, close to the joint surface 48 for the first connector 20, of the fifth pair of protrusions 58, and eighth engaging portions 40*h* which engage side faces 58*b* opposite to the side faces 58*a* of the fifth pair of protrusions 58.

As shown in FIG. 1, the board locks 40 are pressed into the recesses 44 and 46 by a pressing means such as a punch 49 to connect the first and second connectors 20 and 30. The board locks 40 are secured into the recesses 44 and 46 with the legs 41 extending from the side surfaces which will contact a circuit board as attached of the brackets 36 of the second connector 30. Engagement between the engaging portions 40*a* to 40*h* of the board lock 40 and the protrusions 50 to 58 of the recesses 44 and 46 securely connects the first and second connectors 20 and 30. The connector assembly 10 thus assembled is quickly and easily fastened to a circuit board by inserting the legs 41 into corresponding fastening holds (not shown) on the circuit board without fastening screws as in the prior art. The number of protrusions of the board lock and the inner wall of the recess can be increased or decreased, depending on the application thereof.

Figure 4:
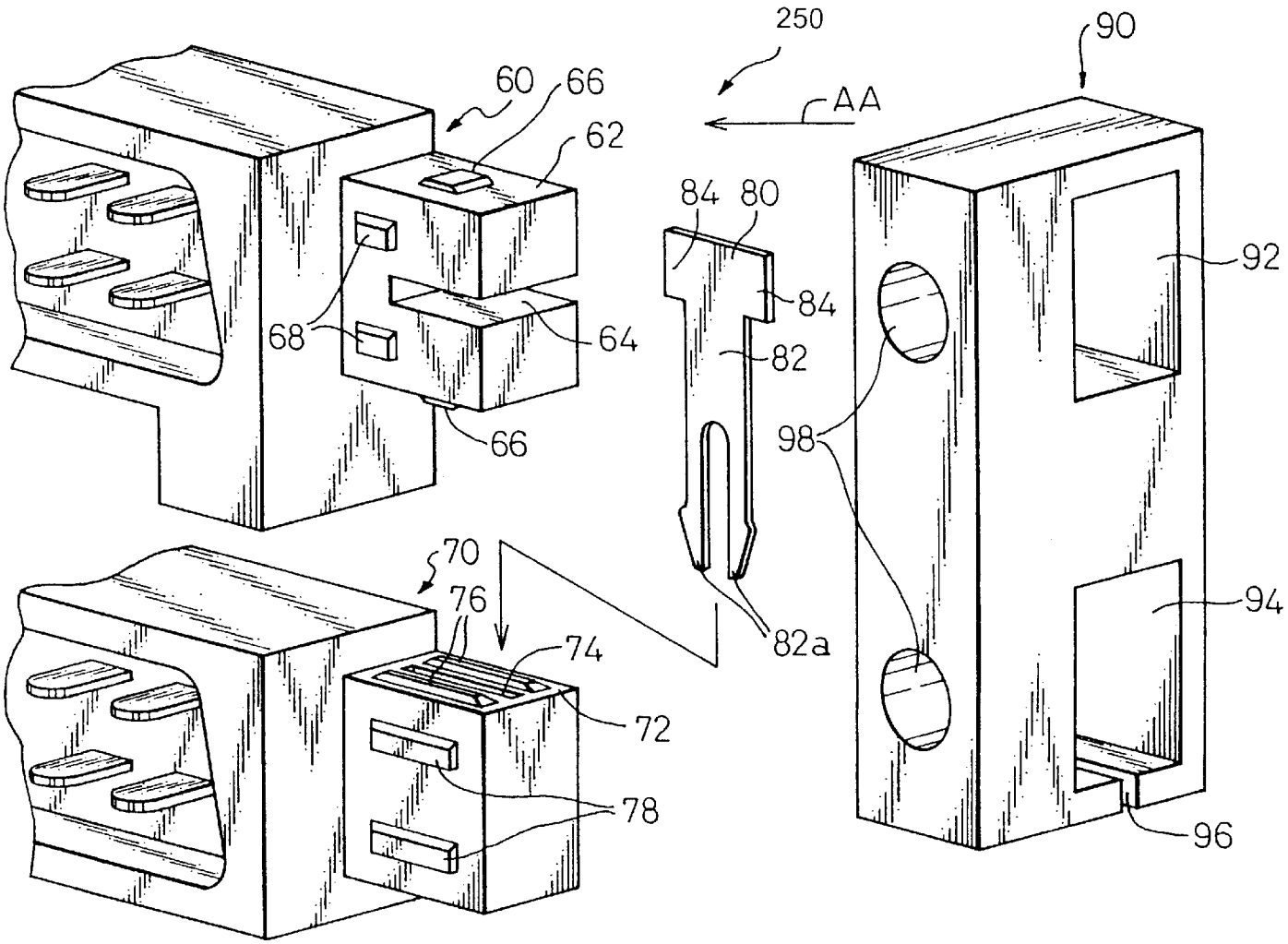
FIG. 4 is an exploded perspective front view of a connector assembly according to a second embodiment of the invention.
Figure 5:
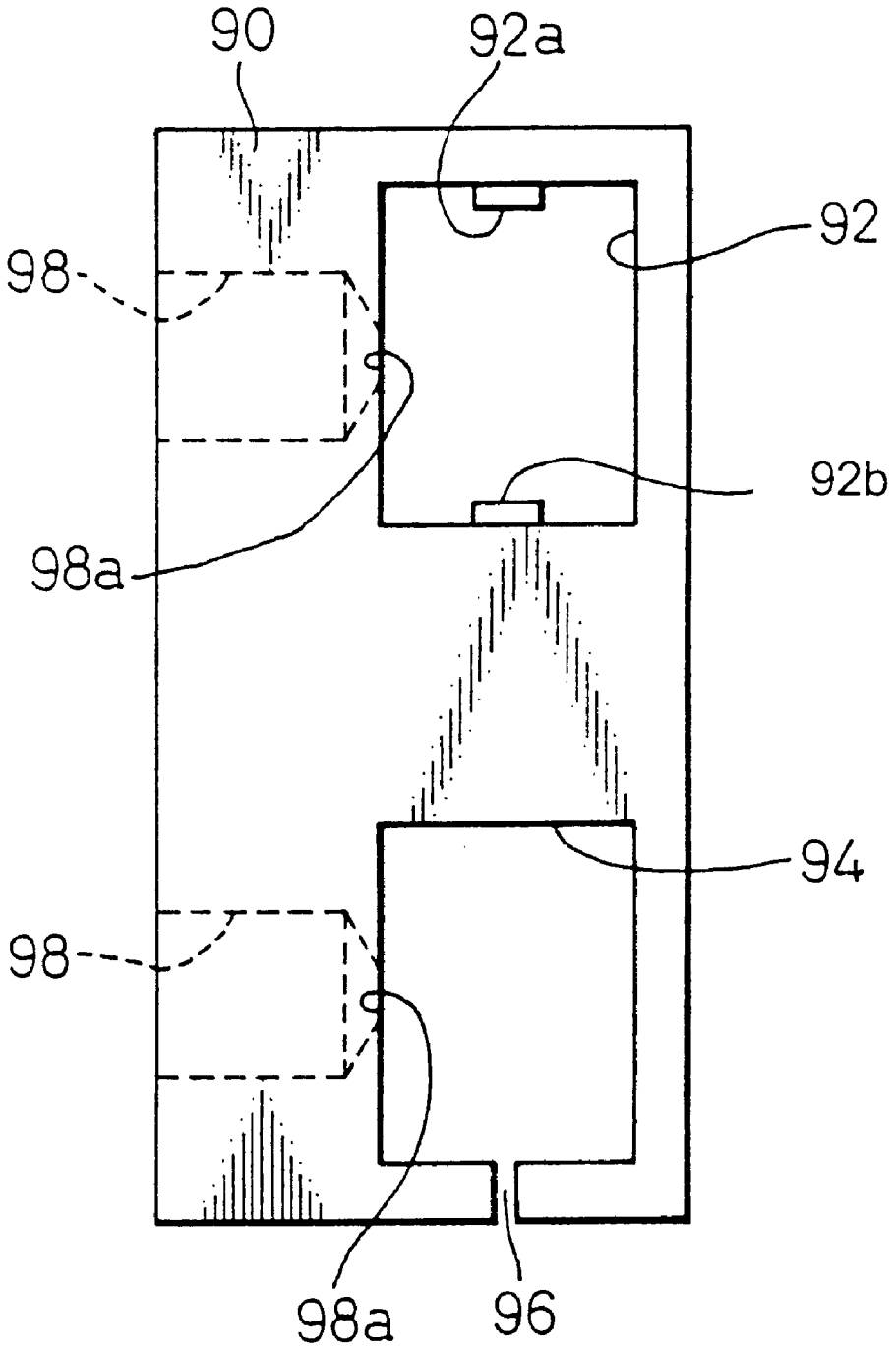
FIG. 5 is a side view of a connecting member according to the second embodiment.
Figure 6:
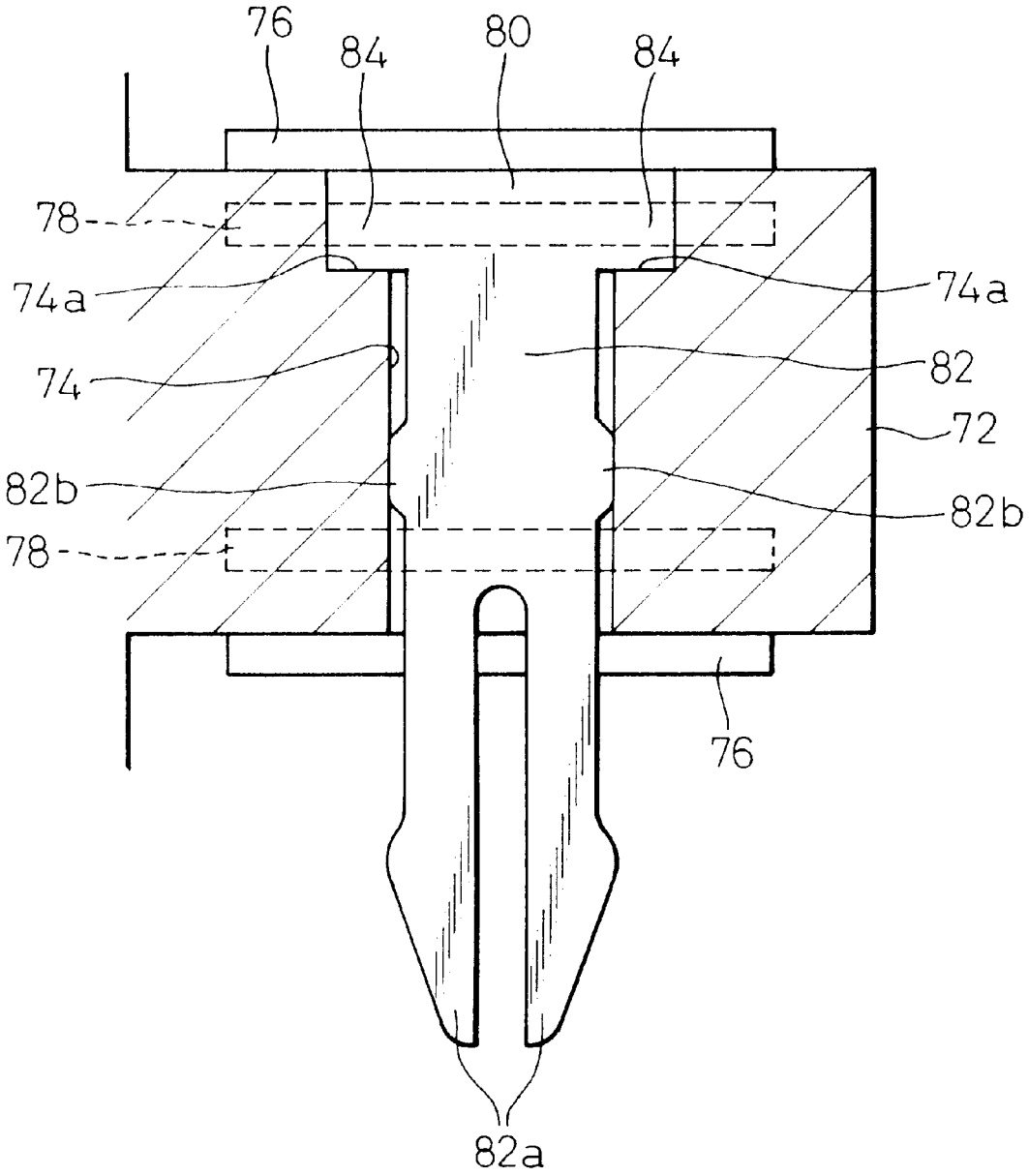
FIG. 6 is a front view of a board lock according to the second embodiment, which is assembled to the connector assembly.
Figure 7:
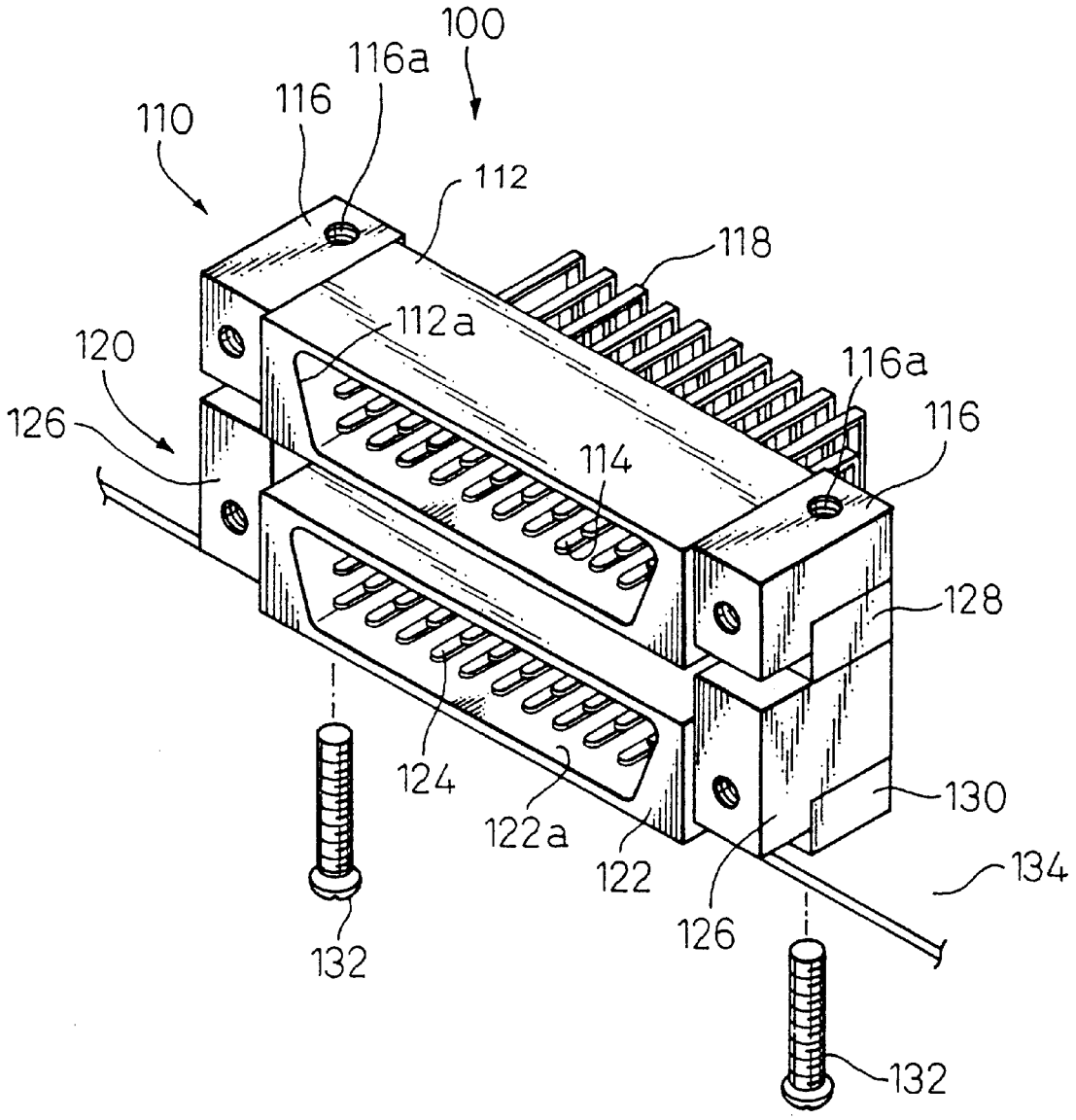
Fig. 7 (PRIOR ART)
FIG. 7 is a perspective front view of a prior art.

With reference to FIGS. 4–6, the second embodiment of the invention will be described.

A connector assembly 250 according to the second embodiment of the invention includes first and second connectors 60 and 70 as in the first embodiment. The first and second connectors 60 and 70 are substantially identical to those of the first embodiment, except for arrangements for connecting the first and second connectors 60 and 70 to each other and for attaching the connector assembly to a circuit board. Thus, only differences between the first and second embodiments will be described below to avoid redundancy.

The first connector 60 includes a pair of brackets 62 of an electrically insulating material at the either end thereof. Each of the brackets 62 includes bosses 66 and 68, and a slit 64 extending horizontally in FIG. 4, that is in a direction along which a connecting member 90 is inserted. The second connector 70 also includes a pair of brackets 72 of an electrically insulating material at the either end thereof. Each of the brackets 72 includes bosses 76 and 78, and a slit 74, for receiving a board lock 80, which slit extends perpendicular to the slit 64 from a side facing the bracket 62 of the first connector 60 through the bracket 72 to the opposite side facing a circuit board to which the connector assembly 250 is attached.

The board lock 80 according to the second embodiment has generally a T shape and includes a shank 82, a locking portion which includes a pair of legs 82*a*, engagements 82*b* on the edges of the shank 82 and shoulders 84. The legs 82*a* are adapted to be inserted in to a hole or holes in a circuit board to function as a snapin fastener for locking the connector assembly 250 to the circuit board. With reference to FIG. 6, which shows a section with the board lock 80 inserted into the slit 74, the slit 74 includes shoulders 74*a* which engage the shoulders 84, and extends through the bracket 72. The engagements 82*b* engage the inner walls of the slit 74, which stabilizes the board lock 80 within the slit 74. Engagement between the shoulders 84 and 74*a* helps the stabilization.

The connecting member 90 includes first and second openings 92 and 94 disposed at positions corresponding to the brackets 62 and 72, and slit 96, provided between the second opening 94 and end surface facing a circuit board to which the connector assembly 250 is attached, for allowing the connecting member 90 to pass the board lock 80 when assembled. As shown in FIG. 4, the board lock 80 is inserted into the slit 74, then the connecting member 90 is attached to the first and second connectors 60 and 70 to connect them to each other by inserting the first and second openings 92 and 94 to the brackets 62 and 72. When the connector assembly 250 is thus assembled, the bosses 66, 68, 76 and 78 on the brackets 62 and 72 engage the inner walls of the first and second openings 92 and 94 of the connecting member 90 to secure the connecting member 90 to the brackets 62 and 72. In particular, protrusions 92*a* and 92*b* are provided on the inner wall of the first opening 92, which engage the bosses 66 on the bracket 62 to prevent the detachment of the connecting member. During the assembly of the connecting member 90, the bracket 62 deforms to reduce the width of the slit 64 when the protrusions 92*a* and 92*b* pass over the bosses 66, which facilitates the assembly of the connecting member 90.

The connecting member 90 includes threaded holes 98 which receive screws (not shown) for fastening cables (not shown) to the connector assembly 50. The threaded holes 98 open into the openings 92 through orifices 98*a* which allows plating solution flow into the openings 92 from the threaded holes 98 during a plating process of the connecting member 90. This prevents a drop or drops of plating solution from settling at the end of the threaded hole 98.

It will also be understood by those skilled in the art that the forgoing description is a preferred embodiment of the disclosed device and that various changes and modifications may be made without departing from the spirit and scope of the invention.

We claim:

1. A connector assembly comprising:

a body including a plurality of contacts; a plurality of leads for connecting the plurality of contacts to a plurality of contact points provided on a circuit board to which the connector assembly is attached;

first and second connectors including first and second bodies, respectively, adapted to the body of the connector assembly when the first and second connectors are connected to each other, the second connector contacting the circuit board when the connector assembly is attached to the circuit board;

a pair of brackets attached to opposite ends of the first and second bodies, respectively, wherein each of the brackets attached to the second body include slits;

a pair of board locks including legs attaching the connector assembly to the circuit board, the board locks being inserted into the slits, respectively; and connecting members including first and second openings into which the first and second brackets are respectively inserted to connect the first and second bodies to each other.

2. A connector assembly according to claim 1, wherein the connecting members each include slits extending from an inside of the second opening to a side facing the circuit board when the connector assembly is attached to the circuit board, allowing the legs of the board locks to extend from the respective connecting member.

3. A connector assembly according to claim 1, wherein the brackets each include bosses to engage an inner wall of the first and second openings of the connecting members when the brackets are inserted into the first and second openings, respectively.

* * * * *

UNITED STATES PATENT AND TRADEMARK OFFICE

CERTIFICATE OF CORRECTION

PATENT NO.: 6,106,331
DATED : August 22, 2000
INVENTOR(S): Fumio KUROTORI et al.

It is certified that error appears in the above-identified patent and that said Letters Patent is hereby corrected as shown below:

On the title page, insert priority information as follows:

--Japan 09-298781 October 30, 1997--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*